US005597033A

United States Patent [19]

Cali

[11] Patent Number: 5,597,033

[45] Date of Patent: Jan. 28, 1997

[54] BASEBOARD HEATER

[76] Inventor: Philip Cali, 9416 W. Irving Park Rd., Schiller Park, Ill. 60176

[21] Appl. No.: 321,404

[22] Filed: Oct. 7, 1994

Related U.S. Application Data

[63] Continuation of Ser. No. 77,420, Jun. 15, 1993, abandoned.

[51] Int. Cl.[6] ..... F24D 19/02; F28D 1/04

[52] U.S. Cl. ..... 165/55; 165/56; 165/53; 165/171; 165/183

[58] Field of Search ..... 165/53, 55, 56, 165/47, 49, 128, 130, 171, 183

[56] References Cited

U.S. PATENT DOCUMENTS

| | | | |
|---|---|---|---|
| 1,633,032 | 6/1927 | Nordling | 165/57 |
| 1,662,993 | 3/1928 | Williams | 165/56 |
| 2,731,242 | 1/1956 | Borg et al. | 165/56 |
| 2,782,007 | 2/1957 | Glatt | 165/53 |
| 3,074,521 | 1/1963 | Woods | 165/56 |
| 3,356,829 | 12/1967 | Brandenburg | 165/55 |
| 3,366,170 | 1/1968 | Welz | 165/171 |
| 3,582,614 | 6/1971 | Zellers | 165/49 |
| 3,844,340 | 10/1974 | Rasmussen | 165/55 |
| 4,080,703 | 3/1978 | Beck, Jr. | 165/171 |
| 4,160,475 | 7/1979 | Wilbs | 165/55 |
| 4,338,995 | 7/1982 | Shelley | 165/171 |
| 4,759,402 | 7/1988 | Osojnak | 165/171 |
| 4,766,951 | 8/1988 | Bergh | 165/171 |
| 4,879,453 | 11/1989 | Cunningham | 219/213 |
| 5,042,570 | 8/1991 | Schmitt-Raiser | 165/171 |

FOREIGN PATENT DOCUMENTS

| | | | |
|---|---|---|---|
| 0078448 | 5/1983 | European Pat. Off. | 165/53 |
| 0323862 | 7/1989 | European Pat. Off. | 165/56 |
| 0347570 | 12/1989 | European Pat. Off. | 165/53 |
| 1392332 | 2/1965 | France | 165/55 |
| 2035936 | 2/1972 | Germany | 165/49 |
| 1223182 | 2/1971 | United Kingdom | 165/49 |
| 2174188 | 10/1986 | United Kingdom | 165/56 |
| WO93/04321 | 3/1993 | WIPO | 165/55 |

*Primary Examiner*—John K. Ford
*Attorney, Agent, or Firm*—McHale & Slavin, P.A.

[57] ABSTRACT

A fluid dependent baseboard heating device for placement along the base of vertical walls. A support member attaches to each wall and utilizes bendable projections for locking heat transfer panels to the support member. For larger spaces a multiple support member will hold up to three heat transfer panels or a combination of heat transfer panels and non-functional panels. The device allows for placement of the baseboard around the circumference of the room for similarity of baseboard design, yet provides a functional heat panel only for areas requiring warmth. The heat transfer panel accepts hot fluid and by use of a chamber formed between the heat transfer panel and the support member provides an even distribution of heat throughout the chamber and the adjoining room.

11 Claims, 2 Drawing Sheets

BASEBOARD HEATER

This is a continuation of application Ser. No. 08/077,420 filed Jun. 15, 1993, now abandoned.

FIELD OF THE INVENTION

The present invention relates generally to room heaters and, more particularly, to baseboard heaters.

BACKGROUND INFORMATION

Commercial and residential indoor heating is dependant on a number of factors including the number of rooms to be heated, room sizes, ambient temperatures, a rooms ability to retain heat, geographical location, room exposure, amount of windows, and-so forth. Despite the claimed efficiency of a heating system, the above mentioned factors can cause any structure to have heating problems or temperature variations.

Modern heating systems use forced air directed past a heating element before delivery into the room. Forced Air allows for simultaneous heating of multiple rooms as controlled by a single temperature regulator. Thus, actual air distribution is by manual vent control of individual registers. Improper register placement will lead to large temperature variations and attempts to heat a single room will directly affect the remaining rooms.

Hot water radiator heaters are also well known in the art. However, despite the length of time the hot water radiators have been in use, they remain archaic, unsightly, and bulky items requiring a large surface area for proper heat convection. Relying upon circulation of air within the room to raise the room temperature, the large surface area required leaves a permanent obstruction within a room and typically causes the area nearest the radiator to generate the most heat. For this reason, radiator placement is typically placed near, if not beneath, a window which is considered the ideal position for reading chair placement. In addition, the water used to circulate through the radiator may be super heated which can cause scalding to unsuspecting individuals or make it uncomfortable for the individual seated near the radiator.

Relying upon the benefits of hot water heating, baseboard heaters became commonplace to eliminate the single radiator. The baseboard heater is positioned along the base of a wall and allows for individual room regulation. To overcome the small size of baseboard heaters, finned pipes were employed to increase surface space and electric heating elements were also employed. However, both types of baseboard heaters were unsightly room additions that still limited furniture placement next to the wall. Further, electric heating elements provide an area for dust carbonization resulting in soot deposits which cause wall streaking.

U.S. Pat. No. 4,879,453 discloses a self regulating electric baseboard heater. The heater utilizes a space saving design that does not inhibit placement of furniture. However, a disadvantage to the electric heater is the side effects of electromotive force produced by the use of electricity. Since baseboard heaters are located along the floor of the room, small children will inevitably play within feet of the electrical heaters causing unacceptable health risks.

Therefore, what is lacking in the art is a heating system that provides the benefits of hot fluid heat systems utilizing a small amount of space currently available only with electrically operating baseboards.

SUMMARY OF THE INVENTION

The present invention satisfies the aforementioned needs by teaching an improved baseboard heating device that relies upon fluid heat to supplement or replace conventional heating systems.

The heating device of the present invention utilizes a single piece support member to which a plurality of heating transfer panels is coupled to. The support member is secured to the base of a wall in place of baseboard molding. The transfer panels consist of a heat panel having a fluid carrier pipe depending from the inner surface. Unique to the device is the panel attachment mechanism and placement of the fluid carrying pipe in the volume of space formed between the panel and support bracket for distribution of heat throughout the structure. Set back from the surface of the heat panel, the fluid carrying pipe will not allow direct contact to avoid scalding.

For ease of installation and repair, the panel attachment mechanism is based on interlocking brackets or flanges which lock the heat panel to the mounting bracket. To accommodate future expansion, a non-functional panel can be used in place of the heat panel allowing flexibility to alter available radiator surface area. The flexibility allows the use of additional heat panels for larger rooms or supplement existing heating systems during cold periods.

Accordingly, a primary object of the present invention is to provide a baseboard trim that is functional, decorative, low in cost, easy to install, and is used to supplement or replace conventional heating systems.

Still another object of the present invention is to provide a baseboard heater that can be used with all types of heating systems including, but not limited to, oil, gas, district, heat pumps, and alternative energy systems.

Yet still another object of the present invention is to provide a baseboard heater system which allows the use of one, two, or three functional or non-functional heat transfer panels to accommodate any size room.

Another object of the present invention is to provide a baseboard heating system which does not interfere with furniture placement and utilizes an air chamber to provide a uniform distribution of heat.

Still another object of the present invention is to provide a baseboard heater having easy to install locking flanges and does not produce an electromotive force.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
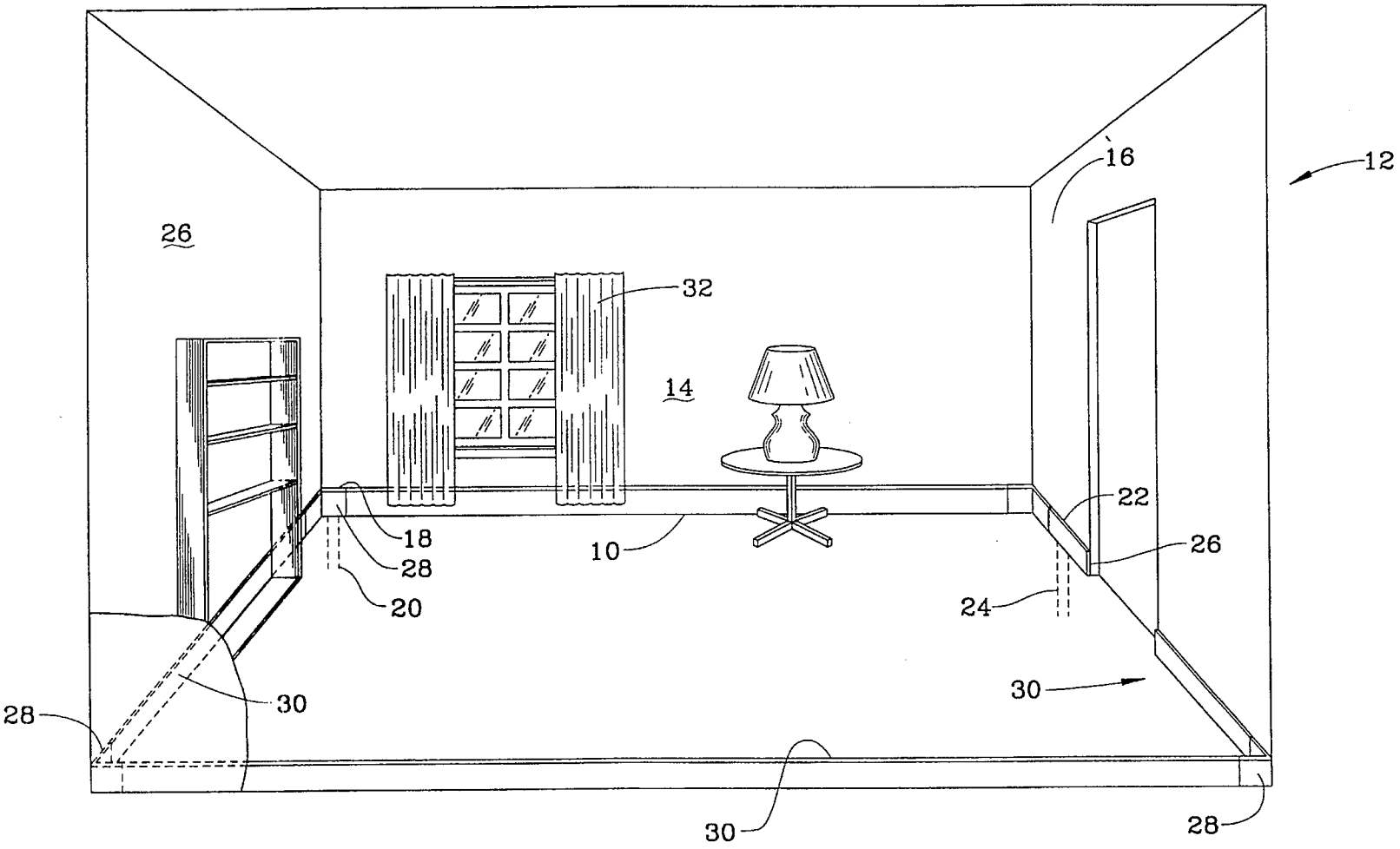
FIG. 1 is a perspective view illustrating a baseboard heating system of the present invention mounted in a room.

Now referring to FIG. 1, shown is the baseboard heater 10 of the present invention set forth in a typical room 12. The baseboard heater 10 is shown mounted against two walls 14 and 16. At one end 18 of the baseboard 10 is an inlet 20 which couples to a conventional fluid heating and regulation system, not shown. At a second end 22 is an outlet 24 for return of heat transfer fluids to the heating source. Around the remainder of the room, depicted by walls 26 and 28, is placed a non-functional baseboard panel 30. The non-functional panel 30 assimilates the shape of the functional baseboard 10 without the use of heat transfer panels. The non-functional baseboard 30 utilizes the same support bracket as the functional baseboard allowing conversion with little effort. A turn down end cover 26 is used at the first end 22 while a right angle corner unit 28 provides an uninterrupted turn around each corner. Each baseboard panel extends approximately 25 mm from each side wall allowing furniture 30 placement and curtain hangings 32 without interference. The baseboard heater provides radiant heat throughout the entire room or can be placed along a single wall, as shown, using matching non-functional baseboard panels for the rest of the room. By use of stacked panels the inlet and return to the heating system can be made at the same location.

Figure 2:
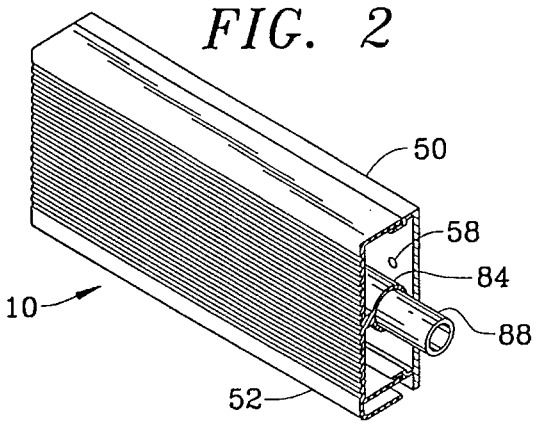
FIG. 2 is a perspective view illustrating a single heat transfer panel coupled to a single mounting bracket.
Figure 3:
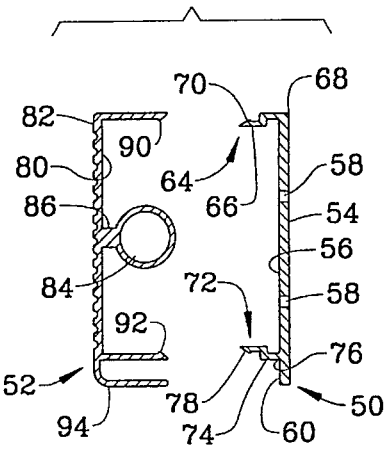
FIG. 3 is a cross sectional exploded side view of FIG. 2.

FIGS. 2 and 3 illustrate a single baseboard heating device 10 delineated by support member 50 and heat transfer panel 52. The support member 50 is defined as a one piece structure having a back surface 54 and a front surface 56. The back surface can be glued to a wall or securement can be obtained by the use of a mechanical attachment means such as nails, screws, or the like via through-holes 58. Lower portion 60 of the support member 50 positions the support member 50 at a fixed distance from the surface of the floor. As described in more detail later in this specification, the distance allows panel attachment 52 without interfering with carpeting or the like flooring materials.

The support member 50 has a perpendicularly oriented locking flange 64 extending obliquely from the front surface 56 at an upper end 68. The top locking flange 64 includes an offset projection 66 which lowers the inward projection from the originating point 68. The offset 66 incorporates a raised ridge 70 with an angular insertion slope and leeward vertical boss for locking purposes. Similarly, a bottom perpendicularly oriented locking flange 72 includes an offset projection 74 which lowers the inward projection from the originating point 76. The offset 74 incorporates a raised ridge 78 that has an angular insertion slope and a leeward vertical boss for locking purposes. The angular insertion slope on each offset 66 and 74 directly oppose each other and are spaced apart between 54 mm and 62 mm. The preferred height of the back surface of a one piece support member is approximately 65 mm. As the support member 50 is completely hidden from view by heat transfer panel 52 upon installation, any construction material amendable to the instant locking mechanism is suitable. For example, plastic provides low cost materials and is resistant to heat while aluminum provides long life, has heat transfer ability and creates a stronger support.

The heat transfer panel 52 has an inner surface 80 and an outer surface 82. The inner surface 80 includes a centrally disposed hollow pipe chamber 84 extending longitudinal along the length of the heat transfer panel 52. The hollow pipe chamber 84 is predisposed at a predetermined distance, centerline of hollow pipe is between 15 mm and 20 mm from the front surface 82 of the panel 52, for optimum heat disipation. The chamber is formed by a relatively thin sidewall, and supported by a thick base support 86 to prevent water hammer damage. A copper tube 88, or the like fluid carrying material, can be permanently attached to the chamber 84 for fluidly communicating the heat transferring fluid throughout the panel 52. Copper permits ease of installation by allowing conventional sweating for joints.

The heat transfer panel 52 utilizes a perpendicularly oriented locking flange 90 extending obliquely from the inner surface 80. The top locking flange 90 incorporates a raised ridge that has an angular insertion slope and a leeward vertical boss for locking purposes. Similarly, a bottom locking flange 92 incorporates a raised ridge that has an angular insertion slope and a leeward vertical boss for locking purposes. The angular insertion slope on each locking flange 90 and 92 are operatively associated with the locking flanges of 64 and 72 respectively of the support member 50. At the bottom of the heat transfer panel 52 is provided an extension shield 94 that is useful in installation by deferring the carpet away from lower locking flange 92.

Figure 4:
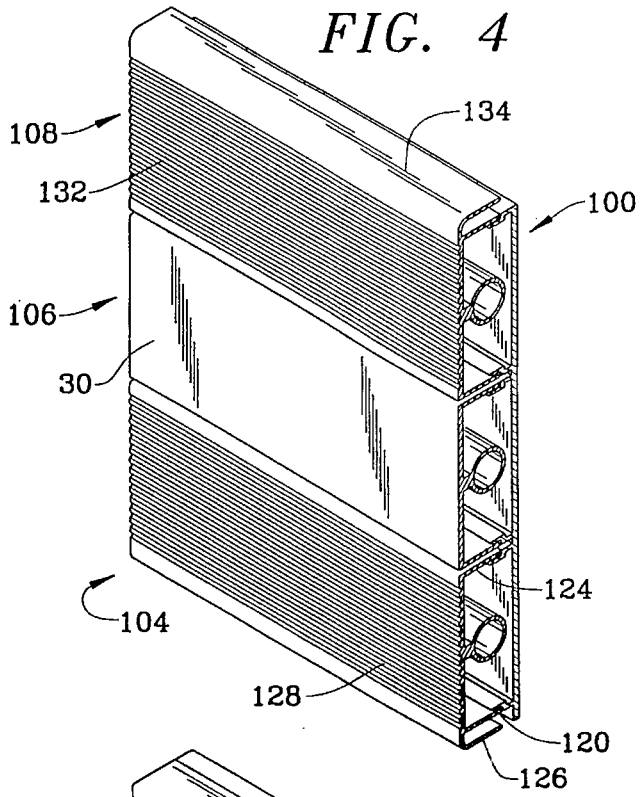
FIG. 4 is a perspective view illustrating a triple heat transfer panel coupled to a triple mounting bracket.
Figure 5:
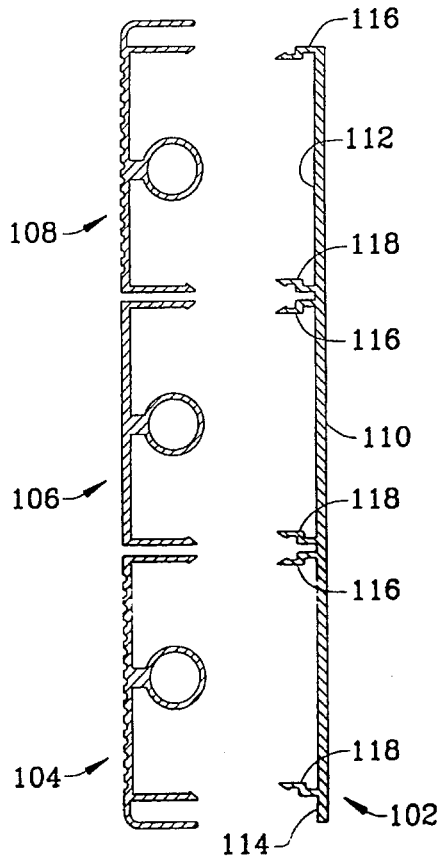
FIG. 5 is a cross sectional exploded side view of FIG. 4.

Referring to FIGS. 4 and 5, shown is the multiple baseboard heating device 100 delineated by a support member 102, lower heat transfer panel 104, middle heat transfer panel 106, and upper heat transfer panel 108. The support member 102 is defined as a one piece support structure having a back surface 110 and a front surface 112. As mentioned above, the back surface can be glued to a wall or securement can be obtained by the use of a mechanical attachment means such as nails or screws. A lower portion 114 of the support member 102 is positioned a fixed distance from the surface of the floor providing panel attachment 104 without interfering with carpeting or other flooring materials.

The support member 102 has three upwardly facing perpendicularly oriented locking flanges 116 extending from the front surface 112. Each locking flange 116 includes an offset projection which lowers the inward projection from the originating point and incorporates a raised ridge that has an angular insertion slope and a leeward vertical boss for locking purposes. Similarly, the support member 102 has three downwardly facing perpendicularly oriented locking flanges 118 which include an offset projection which lowers the inward projection from the originating point and incorporates a raised ridge that has an angular insertion slope and a leeward vertical boss for locking purposes. The angular insertion slope on each locking flange 116 and 118 directly oppose each other and are spaced apart between 54 mm and 62 mm. The preferred height of the back surface is approximately 105 mm.

It will be obvious to one of ordinary skill in the art that the support panel can be made to house two panels, preferably with a height of approximately 136 mm. The use of two panels allows the heat transfer fluid to travel in one direction and, by use of a 180 degree loop, return to the point of entry. This allows water inlet and outlet, typically installed through a floor board to occur at the same location if not the same opening. It is obvious that the dimensions set forth by the inventor could be changed without defeating the purpose of his invention.

As the support member 102 is hidden from view once the heat transfer panels 104, 106, and 108 are installed, any construction material may be used that is amendable to the locking mechanism. Similar to the aforementioned heat transfer panels, each panel 104, 106, and 108 includes an inner surface with a centrally disposed hollow pipe chamber extending longitudinally along the length of the heat transfer panel. A fluid carrier, such as copper tubing can be permanently attached to the hollow pipe chamber for fluidly communicating the heat transferring fluid throughout the panel.

The heat transfer panel 104 is shown with perpendicularly oriented locking flanges 120 and 124 which incorporate the aforementioned raised ridge and leeward vertical boss for locking purposes. By use of extension shield 126 the heat transfer panel 104 is an exact duplicate of heat transfer panel 52. The outer surface 128 of the heat transfer panel 104 is shown with a plurality of surface ridges which provide additional surface area as well as ornamental design. Middle heat transfer panel 106 is shown with a smooth outer surface 130 while upper heat transfer panel 108 includes the use of a ridge design on its outer surface 132. Variations of the design are deemed within the scope of this invention and may take the form of traditional or other styles of moldings. The outer surface of each panel defines an ornamental shape conversant with room decor, and is receptive to painting if not previously colored. A shield 134 can also be formed into the upper heat transfer panel providing a smooth transition to the locking flange as well as hiding the flange joint. The inner surfaces of the heat transfer panel 104, 106, and 108 and the inner surface of the support member 104 cooperate to define a free air chamber encompassing the pipe. Thus, the heating tube heats both the panel and air chamber which in turn radiates the heat to the room.

Figure 6:
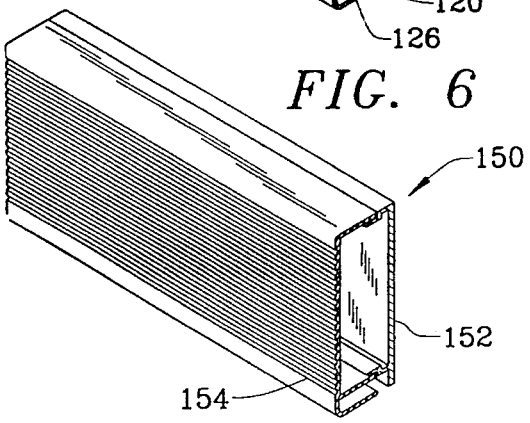
FIG. 6 is a perspective view illustrating a single cover coupled to a single mounting bracket.

FIG. 6 sets forth a non-functional baseboard panel 150 used to supplement the aforementioned functional baseboard panels. The support member 152 is the same as previously described in FIG. 2 while the panel 154 does not include the heat transfer tube. The non-functional panel provides baseboard symmetry throughout the room and further provides a means for increasing the heating capability by removal of the non-functional panels and replacement with functional panels.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What I claim is:

1. A baseboard heating device adapted to be mounted against the base of a vertical wall at or near a floor comprising:

a single piece support member having a length and a back surface and a front surface, said back surface secured lengthwise along the base of a vertical wall, said front surface of said support member having at least two spaced apart sidewalls formed thereto, each said sidewall formed from an edge wall having a first length formed perpendicular to said back surface leading to an inwardly disposed offset wall formed parallel to said back surface of a second length and a locking flange formed parallel to said edge wall of a third length, said locking flange having an outwardly facing raised ridge which tapers along an angular insertion slope to a projecting edge;

at least one heat transferring panel constructed of aluminum having an inner surface and an outer surface and a length, said inner surface having a centrally disposed hollow pipe chamber positioned a predetermined distance from said inner surface, said pipe chamber having an outer surface that is substantially exposed to free air space at a distance from said inner surface extending longitudinally along said length of said inner surface of said panel, said panel having spaced apart sidewalls having a first length formed perpendicular to an inner surface leading to an inwardly facing raised ridge which tapers along an angular insertion slope forming an insertion edge;

whereby said inner surface of said panel and said front surface of said support member cooperate to define a free air chamber encompassing said pipe chamber for distribution of heat convected during fluid transfer though said pipe chamber throughout said panel.

2. The baseboard heating device according to claim 1 wherein said outer surface of said heat transfer panel defines an ornamental design conversant with room decor, said surface receptive to painting.

3. The baseboard heating device according to claim 2 wherein said outer surface of said heat transfer panel is smooth.

4. The baseboard heating device according to claim 2 wherein said outer surface of said heat transfer panel includes a plurality of collinear placed ridges providing an increased exposed surface area.

5. The baseboard heating device according to claim 1 wherein each said locking flange forms a side wall to said support member.

6. The baseboard heating device according to claim 1 wherein each said locking flange forms a side wall to said heat transfer panel.

7. The baseboard heating device according to claim 1 wherein said heat transfer panel includes at least one extension shield.

8. The baseboard heating device according to claim 1 wherein said chamber is receptive to fluidly coupling to copper tubing.

9. The baseboard heating device according to claim 1 wherein said support member is constructed of a non-metallic material.

10. A baseboard heating device adapted to be mounted against the base of a vertical wall structure at or near a floor comprising:

a single piece support member defined by a back surface, a length and a front surface, said back surface secured lengthwise along the base of a vertical wall, said front surface of said support member having two opposing sets of spaced apart sidewalls formed thereto, each said sidewall formed from an edge wall having a first length formed perpendicular to said back surface leading to an inwardly disposed offset wall formed parallel to said back surface of a second length and a locking flange formed parallel to said edge wall of a third length, said locking flange having an outwardly facing raised ridge which tapers along an angular insertion slope forming an insertion edge; and two heat transfer panels constructed of aluminum and each having a length with an inner surface and an outer surface with a centrally disposed hollow pipe chamber a predetermined distance from said inner surface, said pipe chamber having an outer surface that is substantially exposed to free air space at a distance from said inner surface extending longitudinally along said length of said inner surface of each said panel, said panel having spaced apart sidewalls having a first length formed perpendicular to said inner surface leading to an inwardly facing raised ridge which tapers along an angular insertion slope forming an insertion edge;

said inner surface of each said heat transfer panel and said front surface of said support member cooperating to define a free air chamber encompassing a portion of each said pipe chamber, said outer surface of said panel available for placement of an ornamental design conversant with room decor and receptive to painting;

whereby said support member is secured to the base of a vertical wall and each said heat transfer panel coupled thereto by engaging said locking flanges, said pipe chamber available for carrying heated fluid for convection through said pipe to said heat transfer panel for the purpose of heating a room.

11. A baseboard heating device adapted to be mounted against the base of a vertical wall structure at or near a floor comprising:

a single piece support member defined by a back surface, a length and a front surface, said back surface secured lengthwise along the base of a vertical wall, said front surface of said support member having three opposing sets of spaced apart sidewalls formed thereto, each said sidewall formed from an edge wall having a first length formed perpendicular to said back surface leading to an inwardly disposed offset wall formed parallel to said back surface of a second length and a locking flange formed parallel to said edge wall of a third length, said locking flange having an outwardly facing raised ridge which tapers along an angular insertion slope forming an insertion edge; and at least one heat transfer panel constructed of aluminum having a length with an inner surface and an outer surface with a centrally disposed hollow pipe chamber a predetermined distance from said inner surface, said pipe chamber having an outer surface that is substantially exposed to free air space at a distance from said inner surface extending longitudinally along said length of said inner surface of each said panel, said panel having spaced apart sidewalls having a first length formed perpendicular to said inner surface leading to an inwardly facing raised ridge which tapers along an angular insertion slope forming an insertion edge;

at least one panel constructed of aluminum having a length with an inner surface and an outer surface, said panel having spaced apart sidewalls having a first length formed perpendicular to said inner surface leading to an inwardly facing raised ridge which tapers along an angular insertion slope forming an insertion edge;

said inner surface of each said panel and said front surface of said support member cooperating to define a free air chamber, said outer surface of each said panel available for placement of an ornamental design conversant with room decor and receptive to painting;

whereby said support member is secured to the base of a vertical wall and each said panel coupled thereto by engaging said locking flanges wherein said pipe chamber is available for carrying heated fluid for convection through said pipe to said heat transfer panel for the purpose of heating a room.

* * * * *